US009206591B2

(12) United States Patent
Kosarnig

(10) Patent No.: US 9,206,591 B2
(45) Date of Patent: Dec. 8, 2015

(54) FLUSHING DEVICE WITH ODOUR EXTRACTION

(71) Applicant: GEBERIT INTERNATIONAL AG, Jona (CH)

(72) Inventor: Rolf Kosarnig, Ruti (CH)

(73) Assignee: GEBERIT INTERNATIONAL AG, Jona (CH)

( * ) Notice: Subject to any disclaimer, the term of this patent is extended or adjusted under 35 U.S.C. 154(b) by 51 days.

(21) Appl. No.: 14/135,874

(22) Filed: Dec. 20, 2013

(65) Prior Publication Data

US 2014/0173818 A1 Jun. 26, 2014

(30) Foreign Application Priority Data

Dec. 21, 2012 (EP) ..... 12199042

(51) Int. Cl.

| | |
|---|---|
| ***E03D 9/04*** | (2006.01) |
| ***E03D 9/05*** | (2006.01) |
| ***E03D 9/052*** | (2006.01) |
| ***E03D 1/34*** | (2006.01) |
| ***E03D 13/00*** | (2006.01) |

(52) U.S. Cl.

CPC .. *E03D 9/05* (2013.01); *E03D 1/34* (2013.01); *E03D 9/052* (2013.01); *E03D 13/005* (2013.01)

(58) Field of Classification Search

CPC ..... E03D 9/052

USPC ..... 4/213, 300–442

See application file for complete search history.

(56) References Cited

U.S. PATENT DOCUMENTS

| | | | |
|---|---|---|---|
| 5,353,433 | A | 10/1994 | Sherman |
| 5,369,813 | A | 12/1994 | Goddard et al. |
| 2008/0307570 | A1 | 12/2008 | Marks |

FOREIGN PATENT DOCUMENTS

| | | | |
|---|---|---|---|
| EP | 1 169 522 | A | 1/2002 |
| EP | 2 336 435 | A1 | 6/2011 |
| WO | 00/11278 | A1 | 3/2000 |
| WO | 2005/045145 | A1 | 5/2005 |

*Primary Examiner* — Lori Baker

(74) *Attorney, Agent, or Firm* — Sughrue Mion, PLLC

(57) ABSTRACT

A flushing device (1) comprises an extraction device (2) for extracting odours from a sanitary device such as a toilet bowl or a urinal, a cistern (3) for holding flushing water, a fill valve (4) for filling the cistern (3) and a flush unit (5) for providing flushing water, wherein the flush unit (5) comprises a flush valve (6) with an overflow pipe (7) and an actuator element (8) for operating the flush valve (6). The extractor unit comprises a fan (9) for extracting air through an air duct (10), which extends at least partially through the cistern (3), and a filter element (11) for filtering the air, wherein the filter element (11) represents the end of the air duct (10). The actuator element (8), fan (9) and filter element (11) are mounted on a common housing (12), particularly arranged in a common housing (12).

23 Claims, 5 Drawing Sheets

FLUSHING DEVICE WITH ODOUR EXTRACTION

TECHNICAL FIELD

The present invention relates to a flushing device with an extraction unit for extracting odours from a sanitary device such as a lavatory bowl or urinal, according to the preamble of claim 1.

PRIOR ART

EP 1 169 522 shows a device for extracting odours from a toilet bowl. According to the device in EP 1 169 522, a fan with a filter is arranged in the cistern, via which fan air can be extracted from the toilet bowl, wherein the air is then conducted through the filter.

The disadvantage of EP 1 169 522 is that the individual components can only be installed in a very time-consuming manner. The individual components have a functional relationship. If they are incorrectly installed, this functional interaction can be disrupted. Installation must therefore be undertaken with great care, something that is very time-consuming. Establishing this functional interaction between components in particular is laborious.

The fact that many of the individual components can come into contact with the flushing water, particularly when installed incorrectly, thereby massively restricting their service life and also reliability, is also disadvantageous.

REPRESENTATION OF THE INVENTION

Starting form this prior art it is an object of the invention to provide a flushing device with odour extraction elements which are easier to install. A further problem is that of specifying a flushing device that is more reliable and has a longer service life.

This problem is solved by a flushing device according to the subject-matter of claim 1. According to this, a flushing device comprises an extraction unit for extracting odours from a sanitary device such as a toilet bowl or a urinal, a cistern for holding flushing water, a fill valve for filling the cistern and a flush unit for providing flushing water. The flush unit comprises a flush valve with an overflow pipe and an actuator element for operating the flush valve. The extractor unit comprises a fan for extracting air through an air duct extending at least partially through the cistern and a filter element for filtering the air, wherein the filter element represents the end of the air duct. The start of the air duct preferably lies in the sanitary device. The aforementioned actuator element, the aforementioned fan and the aforementioned filter element are mounted on a common housing, particularly arranged in a common housing.

The mounting of the actuator element, fan and filter element on or in a common housing has the advantage that the elements are easier to install. In addition, the elements are protected by the housing and do not come into contact with the flushing water.

The housing preferably has an upper housing part and a lower housing part, which can be interlocked with one another. The housing in this case can be inserted in the cistern as a whole or as a subassembly. In another embodiment it is also conceivable for the lower housing part to be installed in the cistern and for the upper housing part then to be connected to the lower housing part.

The housing preferably provides part of the air duct and is designed to be leak-proof in relation to air, particularly preferably also in relation to water. The overflow pipe discharges into the housing, wherein the overflow pipe provides part of the aforementioned air duct.

The air duct is therefore provided by the overflow pipe and the aforementioned housing. The overflow pipe discharges opposite the housing into an opening in the cistern, preferably into the discharge opening, which is connected to the sanitary device using a discharge pipe. Viewed from the sanitary device, the air duct is therefore provided by the discharge pipe, the overflow pipe and the aforementioned housing.

A seal is preferably arranged between the upper housing part and the lower housing part. The seal may be a separate seal, such as a rubber seal, or be integrated on the upper housing part or on the lower housing part. In the latter case, it would be conceivable for the seal to be provided by two contact surfaces.

The housing preferably lies above the water line of the cistern for the most part and therefore has only minimal contact with the flushing water when the cistern is completely full. The service life of the sanitary device is further increased as a result of this.

The housing is preferably designed separately from the cistern and mounted on or in the cistern. The housing is therefore connected to the cistern.

The housing is particularly preferably connected to the cistern via a snap-action connection. In a particularly preferred embodiment, the housing is connected to the cistern via the lower housing part, the upper housing part then being indirectly connected to the cistern via the lower housing part.

The fan and the filter element are preferably mounted on the upper housing part. Furthermore, the actuator element is preferably mounted at least partially on the lower housing part. A functional separation of the individual elements, which is advantageous during maintenance, is thereby achieved.

The actuator element particularly preferably comprises at least one motor and an actuator lever driven by the motor. The motor is preferably a servo motor. The motor particularly preferably acts with an output lever on the at least one actuator lever. The output lever thereby raises the actuator lever, which for its part then acts on the flush unit, particularly on the flush valve.

The output lever in this case is movable from a neutral position into at least one flushing position. The output lever is particularly preferably not in contact with the actuator lever in the neutral position, but comes into contact with it during movement to the output lever.

The actuator lever of the actuator element is preferably mounted on the lower housing part and the motor on the upper housing part. The electrical elements and mechanical elements are therefore separated.

During maintenance it is therefore possible for the electrical elements—the motor and possibly the fan in this case—to be maintained by dismantling the upper housing part, while the mechanical elements remain untouched during this maintenance work. During the dismantling of the upper housing part, the output lever is in a maintenance position or neutral position, so that it is not in engagement with the actuator lever.

The housing preferably comprises an opening through which at least one control rod of the flush valve can be guided, wherein the at least one control rod is connected to the at least one actuator lever.

The actuator element is particularly preferably arranged on a bearing element which is connectable to the housing, particularly to the lower housing part. The actuator element can preferably be inserted with the bearing element into the lower housing part.

The housing preferably further comprises a control cam for aligning the actuator element during installation. The control cam moves the actuator lever when connecting the bearing element to the housing, such that the actuator lever can be brought into engagement with the flush valve, particularly with the control rod.

The control cam is particularly preferably arranged on the lower housing part, wherein during installation the lower housing part is installed in the cistern first and the actuator element is then connected to the lower housing part, wherein the actuator element makes contact with the flush valve. The upper housing part is then connected to the lower housing part.

Particularly preferably, the housing has an edge sticking out from the housing around the aforementioned opening, which edge extends away from the housing into the inside of the cistern up to beneath the water line when the cistern is completely full. This means that the circumferential edge comes into contact with the water, as a result of which the water provides a seal, so that air cannot be drawn out of the cistern into the housing through the opening.

The filter element is preferably a filter cartridge which is mounted in a replaceable manner in a holder integrally formed on the housing. The holder in this case preferably has a form that matches the filter cartridge.

In the region of the holder, the housing has a further opening via which air can be fed to the filter element. In other words, the filter element lies in front of this opening. The filtered air in this case is delivered into the inside of the cistern.

In a development of the invention, the fill valve is connected to the housing or is mounted on the housing.

Further embodiments are specified in the dependent claims.

BRIEF DESCRIPTION OF THE DRAWINGS

Preferred embodiments of the invention are described in the following with the help of drawings which are only used for explanatory purposes and should not be interpreted as restrictive. In the drawings.

DESCRIPTION OF PREFERRED EMBODIMENTS

Figure 1:
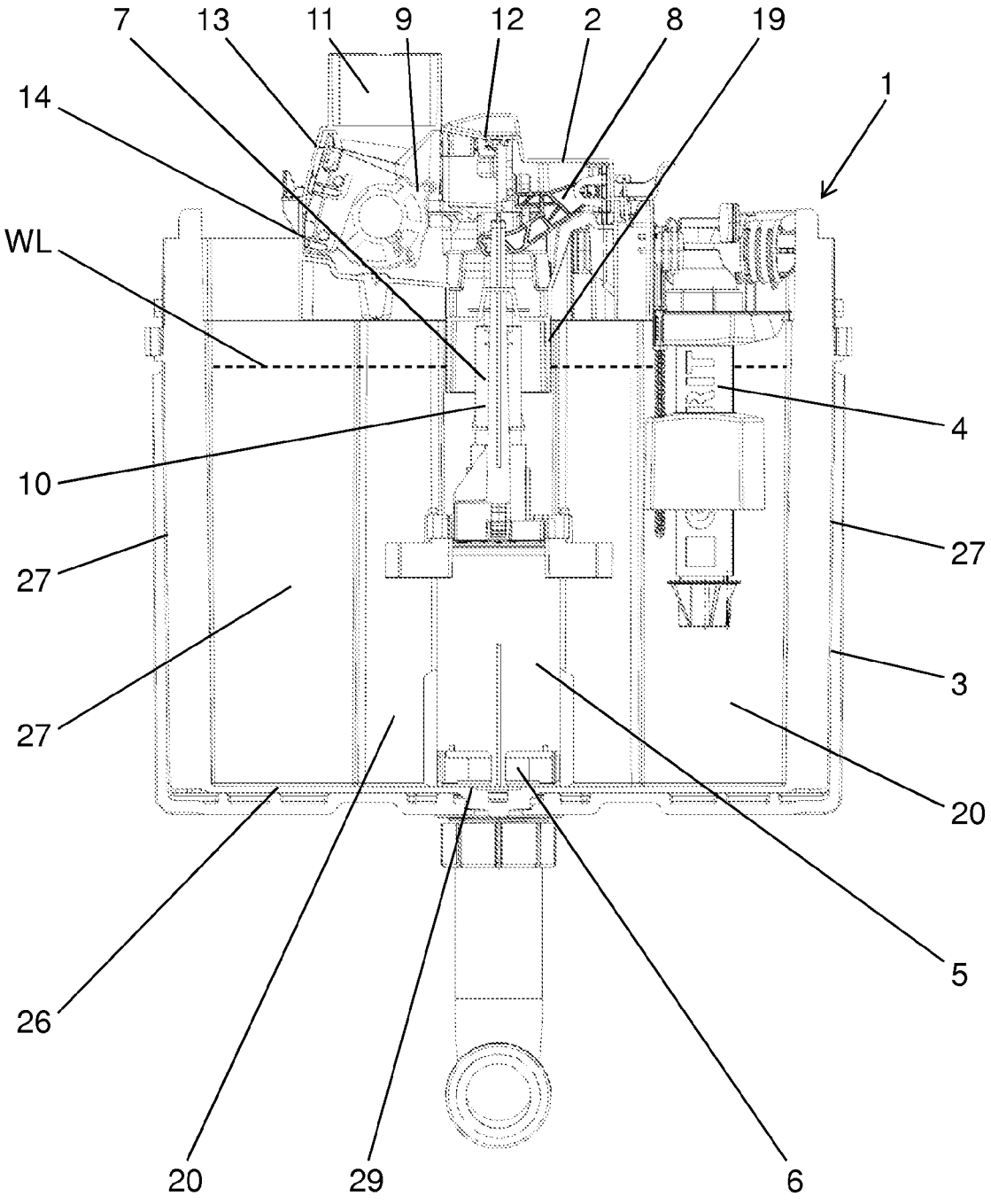
FIG. 1 shows a sectional view of a flushing device according to one embodiment from the front.
Figure 2:
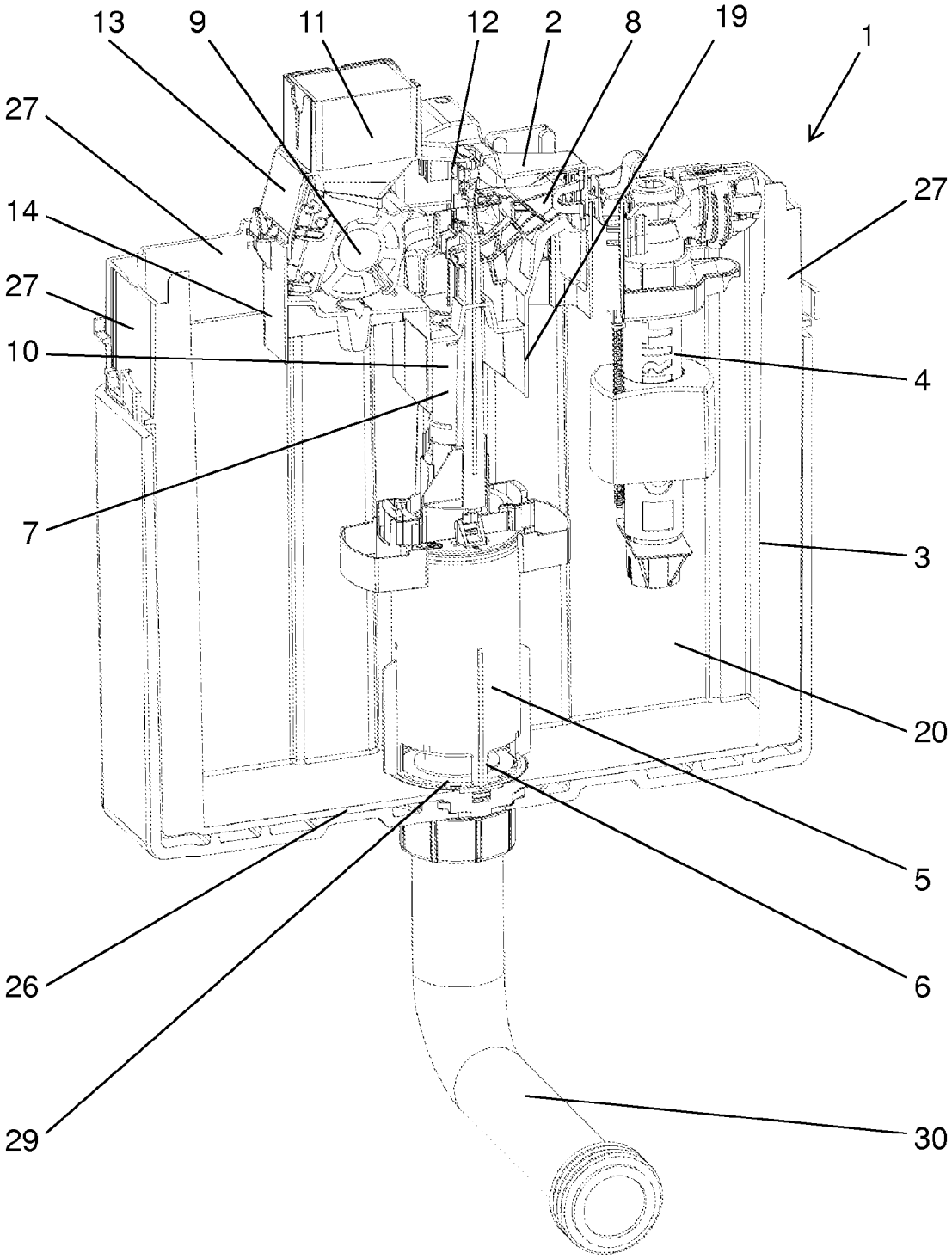
FIG. 2 shows a perspective sectional view of the flushing device according to FIG. 1.

A flushing device 1 according to an embodiment of the invention is shown in the front view in FIG. 1 and the perspective view in FIG. 2.

The flushing device 1 comprises an extraction unit 2 for extracting odours from a sanitary device, a cistern 3 for holding flushing water for flushing the sanitary device, a fill valve 4 for filling the cistern and a flush unit 5 for providing flushing water for flushing the sanitary device.

The sanitary device may be both a urinal and also a toilet bowl.

The cistern 3 comprises a base 26 and side walls 27 extending substantially perpendicularly from the base 26. The front side wall 27 is not shown in FIGS. 1 and 2, in order to allow a view inside the cistern 3. Four side walls 27 and the base 26 in this case provide the cistern 3 with an inside space 20. The inside space 20 is used to hold water. The cistern 3 is designed with an open top in this case. However, it may also be provided with a corresponding cover.

In the region of the base 26, the cistern 3 comprises a discharge opening 29. Beneath the opening 29 is arranged a discharge pipe 30 which can be connected to the sanitary device. The discharge pipe 30 is connected to the cistern 3, for example using a connection piece integrally moulded onto the cistern 3.

The flush unit 5 comprises a flush valve 6 which closes the opening 29 in the cistern 3. The flush valve 6 can be lifted from the opening 29 in this case, wherein water can then flow through the corresponding annular gap out of the cistern 3 through the discharge pipe 30 to the sanitary device. The flush valve 6 further comprises an overflow pipe 7, which extends along a centre axis. During the flushing action, both the flush valve 6 and also the overflow pipe 7 are lifted from the opening 29. For this purpose, the flush unit 5 comprises an actuator element 8, which is used to actuate the flush valve 6. The flush valve 6 can be moved from a closed position into an open position using the actuator element 8. This essentially involves a lifting of the flush valve 6.

The extraction unit 2 comprises a fan 9 for extracting air through an air duct 10. The air duct 10 extends at least partially through the cistern 3. The extraction unit 2 further comprises at least one filter element 11 for filtering the air extracted from the sanitary device. The filter element 11 may for example contain activated carbon as the filter medium. Other filter media are also conceivable, however. The filter element 11 represents the end of the air duct 10. The air duct 10 in the present exemplary embodiment is provided by the discharge pipe 30 and the overflow pipe 7. The overflow pipe 7 in this case provides the portion of the air duct 10 which extends through the cistern 3. The overflow pipe 10 in this case discharges straight into the discharge pipe 30 and is also used as a safety element if the fill valve 4 fails, so that water is able to reach the discharge pipe 30 via the overflow pipe 7. Overflow pipes 7 of this kind are already known from the state of the art.

The actuator element 8, the fan 9 and the filter element 11 are arranged in a common housing 12 or mounted on a common housing 12. The advantage of this is that the aforementioned elements are protected from external influences by the housing 12 within the cistern and that the aforementioned elements can be fastened in the cistern 3 with a common mechanical base. In addition, the actuator element 8, the fan 9 and the filter element 11 can be installed more easily, because there is a smaller number of parts. The housing 12 is configured separately from the cistern 3 and is fastened in or to the cistern 3. The housing 12 may project partially from the cistern.

Figure 3:
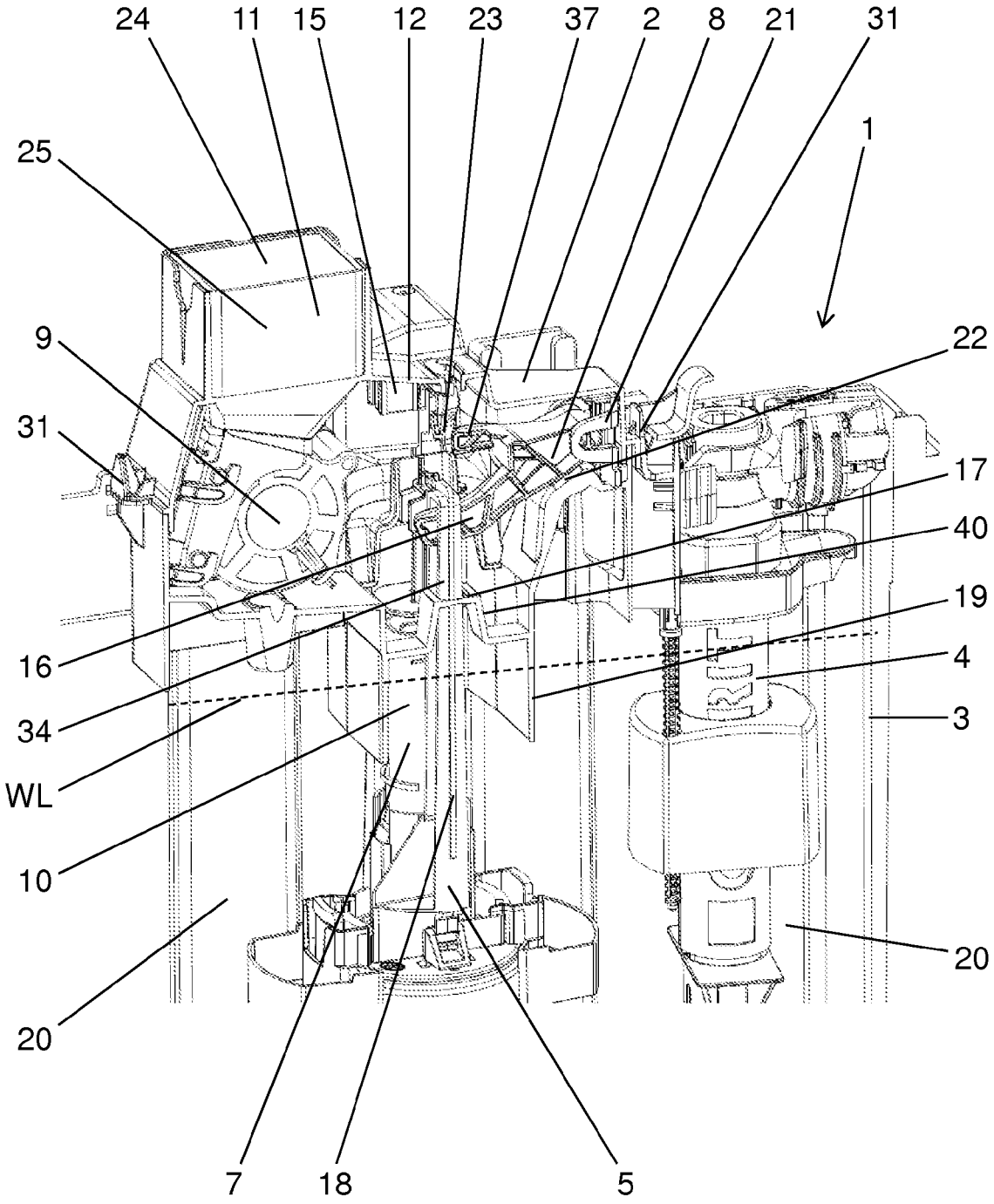
FIG. 3 shows a detailed view of FIG. 2.

The housing 12 is depicted in section in FIGS. 1 to 3, so that the elements arranged in the housing 12 can be identified. The housing is depicted in the non-sectional state in FIG. 4.

FIG. 3 shows an enlargement of FIG. 2. It can be clearly seen here that the housing 12 comprises an upper housing part 13 and a lower housing part 14. The upper housing part 13 in this case can be interlocked with the lower housing part 14. In this case, parts of the upper housing part 13 project into the lower housing part 14.

The connection between the upper housing part 13 and the lower housing part 14 is secured by snap-action connectors 31 in this case. The snap-action connectors 31 can be released accordingly by hand.

The housing 12 provides part of the air duct 10 in this case through the arrangement of the fan 9 within the housing 12. The housing 12 has a leak-proof design in this case in relation to air, particularly preferably also in relation to water. A seal may be arranged between the upper housing part 13 and the lower housing part 14 for this purpose. Alternatively, the sealing effect may also be provided by the neat design of the connection point between the upper housing part 13 and the lower housing part 14, so that there is no need for a separate seal.

In relation to the air duct 10, it should also be noted with regard to FIG. 2 that the air duct 10 is provided by the discharge pipe 30, the overflow pipe 10, the housing 12 and the filter element 11. Consequently, the air can therefore be extracted from the sanitary device in the direction of the cistern 3 via this air duct 10. The air flow in this case runs counter to the flow of flushing water. The filtered air in this case is delivered into the cistern 3. Recycling into the space in which the sanitary device is located would also be conceivable, however.

The water line WL of the flushing water is also drawn in on FIGS. 1 and 3. When the cistern 3 is completely full, the water line WL creates the highest water level. The housing 12 is for the most part above the water line WL in this case. When the cistern 3 is completely full, the housing 12 therefore only has minimal contact with the flushing water. The advantage of this is that the elements arranged in the housing 12 do not come into direct contact with the flushing water, which significantly increases their service life.

In the present embodiment, the housing 12 projects into the flushing water with only one edge 19. The edge 19 therefore extends downwards through the water line WL into the flushing water. The function of the edge 19 is described in even greater detail below.

Figure 4:
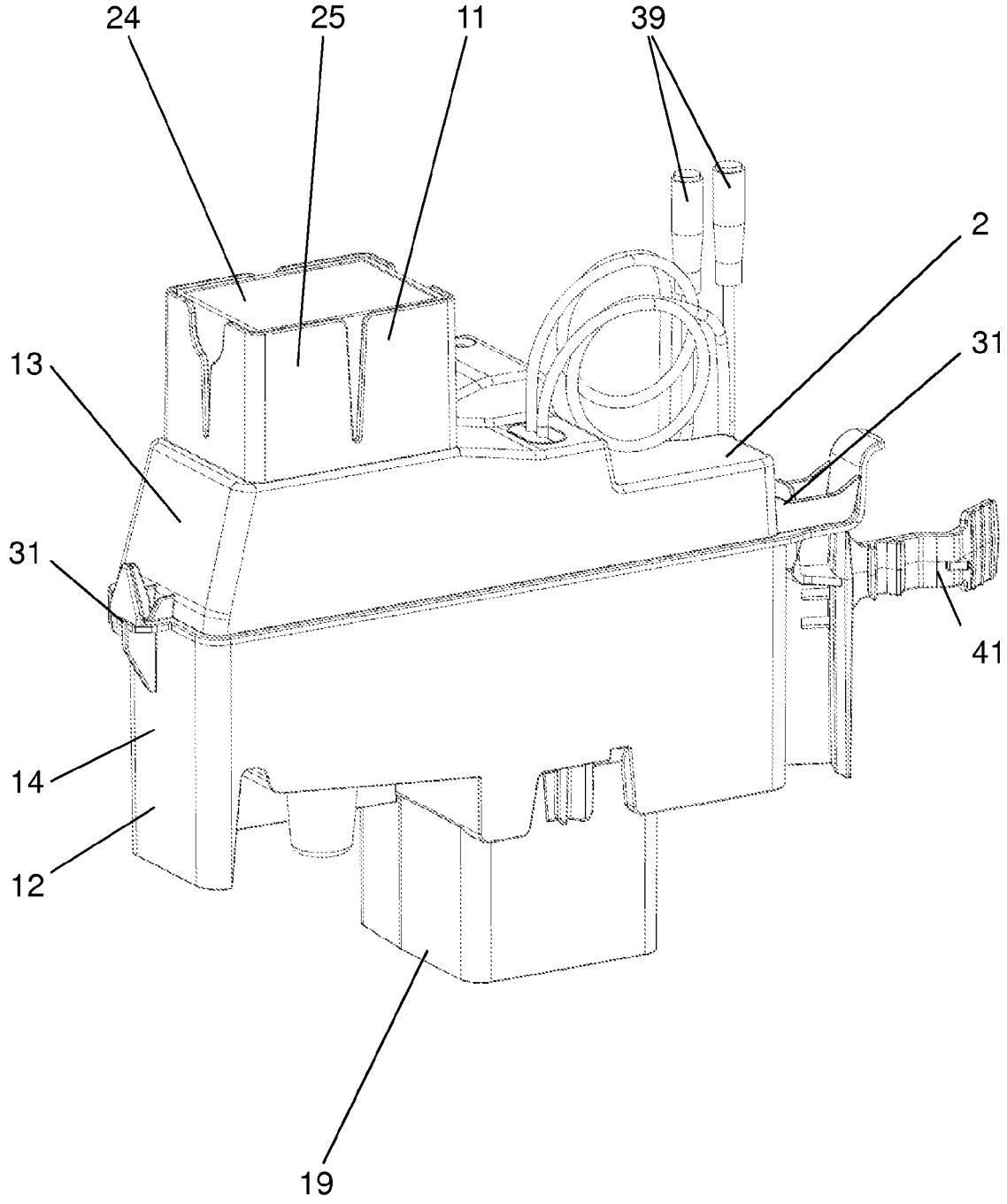
FIG. 4 shows a perspective view of a housing for holding various elements of the flushing device according to FIG. 1.

The housing 12 or the upper housing part 13 and the lower housing part 14 is explained in greater detail with reference to FIGS. 4 to 6.

The fan 9 and the filter element 11 are arranged on the upper housing part 13. The actuator element 8, on the other hand, is arranged on the lower housing part 12. This arrangement has the advantage that the elements which provide the air extraction are mounted on a single housing part. During maintenance of the extraction unit 2, the fan 9 and the filter element 11 in this case, the installation engineer must only therefore undertake work on the upper housing part 13. The flush unit 5, the actuator element 8 in this case, is mounted on the lower housing part 14. During maintenance of the extraction unit 2, the lower housing part 14 can remain in the cistern 3 and does not have to be dismantled. Consequently, the arrangement of the fan 9 and the filter element 11 on the upper housing part 13 and the arrangement of the actuator element 8 on the lower housing part 12 provide a functional separation between the air extraction function and the flushing function.

In relation to the actuator element 8, however, it should also be noted that individual elements of the actuator element 8, such as a motor 15, for example, can also easily be arranged on the upper housing part 13. Although this leads to a reduction in the functional separation, it has other advantages.

The housing 12 is mounted in the cistern. The housing 12 in this case is connected to the cistern 3 via a snap-action connection. The corresponding snap elements are particularly preferably arranged on the lower housing part 14. In other words, the upper housing part 13 is not mechanically connected to the cistern 3, but is connected to the cistern 3 via the lower housing part 12.

The actuator element 8 further comprises a motor 15 and an actuator lever 16 driven by the motor 15 in this case. The actuator lever 16 is connected to a control rod 18 of the flush valve 6 in this case. The control rod 18, which can be identified in FIG. 3, acts on the overflow pipe 7 and the flush valve 6 in this case. Through a movement of the actuator lever 16, the control rod 18 and therefore also the flush valve 6 are raised from the opening 29. Depending on the design of the flush valve, full flushing or partial flushing can take place in this case. The actuator lever 16 in this case either moves into two different positions or the opening is time-controlled.

Figure 6:
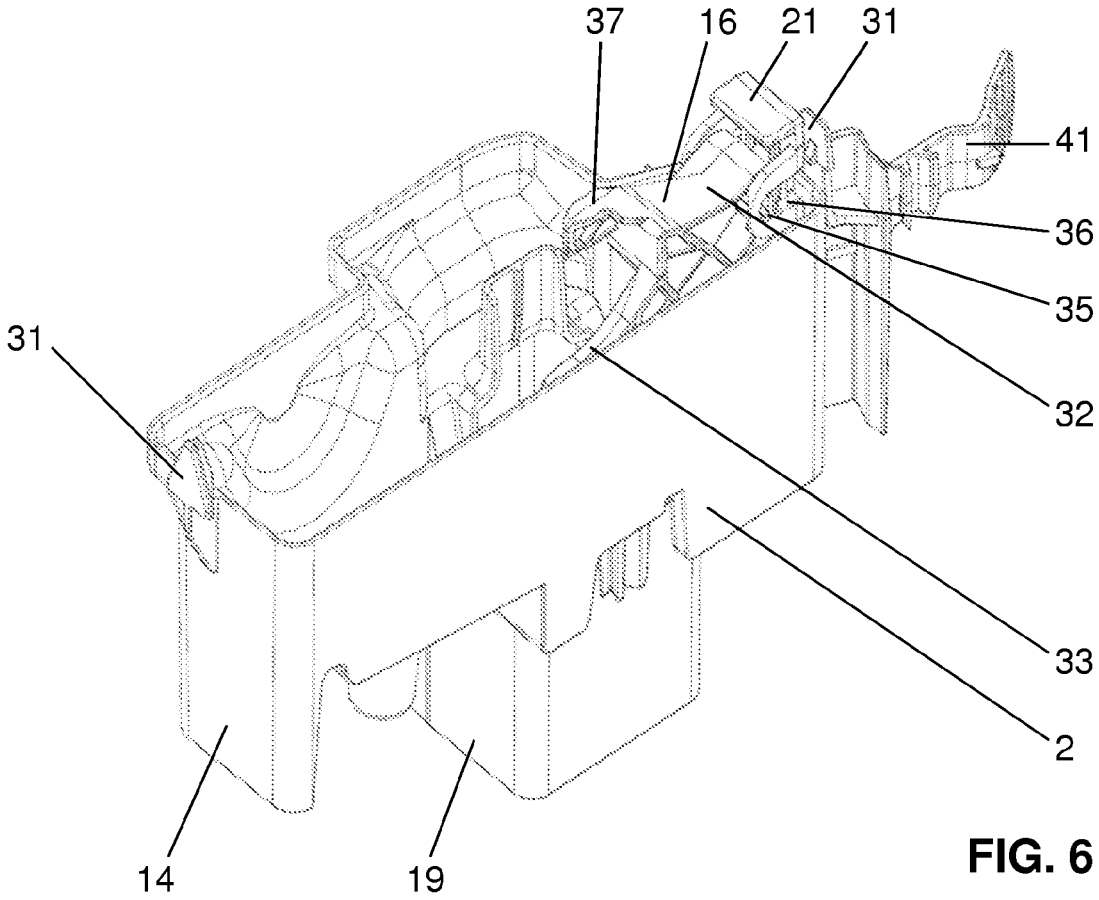
FIG. 6 shows a perspective view of the lower housing part according to FIG. 4.

As can be seen from FIG. 6, the actuator lever 16 comprises a bearing portion 32 and a lever portion 33 in the present embodiment. The actuator lever 16 with the control rod 18 is connected to the lever portion 33, wherein the control rod 18 has an opening 34 for this. The actuator lever 16 with a bearing element 12 is connected to the bearing portion 32. The bearing element 21 can preferably be connected to the housing 12, in this case to the lower housing part 14. The bearing element 21 can preferably be inserted in the lower housing part 14. The actuator lever 16 is pivotably mounted relative to the bearing element 21 in this case. Two pivoting adapters 35 on the actuator lever 16 engage with receiving openings 36 in the bearing element 21 for this purpose.

The actuator lever 16 in this case further comprises an attachment 37. The movement of the motor 15 acts on the actuator lever 16 via the attachment 37. The motor 15 comprises an output lever 23 for transferring movement. The output lever 23 in this case is connected to the output shaft 38 of the motor 15. The output lever 23 makes contact with the attachment 37 in this case. It can be seen in FIG. 3 that the output lever 23 is in the neutral position. If flushing is now actuated, the output lever 23 pivots to the actuator lever 16 and makes contact therewith at the attachment 37, as a result of which the actuator lever 16 and with it the control rod 18 is raised. Flushing is actuated. The output lever 23 is then pivoted back into the neutral position, as a result of which the actuator lever 16 is moved downwards again. The flush valve 16 is then closed again.

The motor 16 with the output lever 23 is arranged on the upper housing part 13 in this case. Consequently, parts of the actuator element 8 are therefore arranged on the upper housing part 13 and parts of the actuator element 8 are arranged on the lower housing part 14. As a result of this, the aforementioned functional separation is not directly achieved. However, the arrangement of the motor 16, as the electrical component, on the same housing part as the fan 9, which is also an electrical component, has the advantage that in the event of an electrical fault, only the aforementioned housing part has to be replaced. Consequently, there is a kind of functional separation here too, between electrical components which are arranged on the upper housing part 13 and mechanical components which are arranged on the lower housing part 14.

It can further be seen in FIG. 3 that the lower housing part 14 exhibits a control cam 22 for aligning the actuator lever 16. If the bearing element 21 is located with the actuator lever 16 in the lower housing part 14, the actuator lever 16 is aligned via the control cam 22. The actuator lever 16 is automatically connected to the control rod 18 via the control cam 22 during installation of the same. Consequently, the actuator lever 16 is therefore guided in a corresponding manner by the control cam 22 during installation.

The housing 12, the lower housing part 14 in this case, comprises an opening 17 through which at least one control rod 18 of the flush valve can be conducted. The control rod 18 therefore projects into the housing 12. The at least one control rod 18 is connected to the at least one actuator lever 16.

The housing 12 comprises a sticking-out edge 19 which extends about the aforementioned opening 17. The edge 19 extends away from the housing 12 and completely surrounds the opening 17. It can clearly be seen from FIG. 3 that in the fitting position the edge 19 ends beneath the water line WL and therefore projects into the water. When the cistern 3 is completely full, the edge 19 therefore extends up to beneath the water line WL. In this way the opening 17 is correspondingly sealed, because no air can reach the opening 17 from above the water line WL.

The opening 17 is preferably arranged in a collar-like portion 40, which extends into the housing 12. During the extraction process, negative pressure prevails within the housing 12. This collar-like portion 40 has the advantage that during the extraction process the water located within the edge 19 cannot be drawn into the housing 12. Consequently, the distance between the maximum water level and the opening 17 is enlarged by the collar-like portion 40.

The filter element 11 is preferably a filter cartridge 24, which is mounted in a replaceable manner in a holder 25 integrally moulded onto the housing 12. The filter element 11 is mounted on the housing 12 in this case. The holder 25 preferably extends from the outside of the housing 12 in this case, so that said housing does not have to be dismantled when replacing the filter cartridge 24. The holder 25 is preferably integrally moulded onto the upper housing part 15. Alternatively, the filter element 11 or else the filter cartridge 24 may also lie within the housing 12.

In the region of the filter element 11, the housing 12 exhibits an opening not depicted here. The filter element 11 then lies over this opening. The opening and the filter element 11 represent the end of the air duct 10 in this case. The fan 9 then lies immediately opposite the filter element 11 on the other side of the opening within the housing 12.

Figure 5:
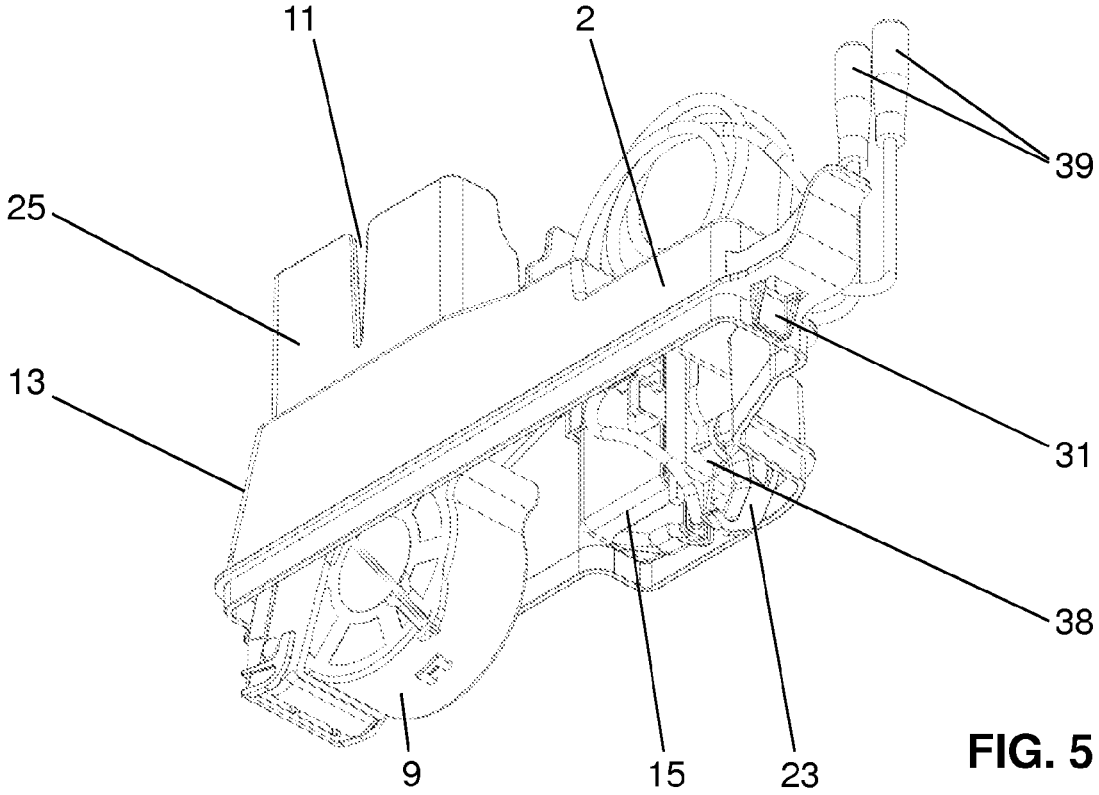
FIG. 5 shows a perspective view of the upper housing part according to FIG. 4

It can be further seen from FIG. 5 that the motor 15 and the fan 9 are provided with cables 39. The two elements can be connected to a control system or a power supply via these cables 39. The cables 39 pass through an opening from the inside of the housing 12 through the housing 12, in this case through the upper housing part 14.

Back to FIG. 3, it can further be seen that the fill valve 4 is likewise mounted on the housing 12. The fill valve 4 is therefore connected to the housing 12. The fill valve may be a fill valve 4 already known from the state of the art. The fill valve 4 has the function of controlling the filling of the cistern 3 after flushing has been actuated.

The housing 12, the lower housing part 14 in this case, has a receiving element 41 for mounting the fill valve 4. The receiving element 4 extends laterally away from the lower housing part 14 and is integrally formed on the lower housing part 14. At this receiving element 41 the fill valve can be connected to the housing 12.

The housing 12 is preferably an injection plastic moulding, wherein the lower housing part 14 is produced separately from the upper housing part 15.

| REFERENCE NUMBER LIST | |
|---|---|
| 1 | Flushing device |
| 2 | Extractor unit |
| 3 | Cistern |
| 4 | Fill valve |
| 5 | Flush unit |

-continued

| REFERENCE NUMBER LIST | |
|---|---|
| 6 | Flush valve |
| 7 | Overflow pipe |
| 8 | Actuator element |
| 9 | Fan |
| 10 | Air duct |
| 11 | Filter element |
| 12 | Housing |
| 13 | Upper housing part |
| 14 | Lower housing part |
| 15 | Motor |
| 16 | Actuator lever |
| 17 | Opening |
| 18 | Control rod |
| 19 | Edge |
| 20 | Inside space |
| 21 | Bearing element |
| 22 | Control cam |
| 23 | Output lever |
| 24 | Filter cartridge |
| 25 | Holder |
| 26 | Base |
| 27 | Side walls |
| 29 | Discharge opening |
| 30 | Discharge pipe |
| 31 | Snap-action connector |
| 32 | Bearing element |
| 33 | Lever portion |
| 34 | Opening |
| 35 | Pivoting adapter |
| 36 | Receiving opening |
| 37 | Attachment |
| 38 | Output shaft |
| 39 | Cable |
| 40 | Collar-like portion |
| 41 | Receiving element |

The invention claimed is:

1. A flushing device comprising an extraction device for extracting odours from a sanitary device such as a toilet bowl or a urinal, a cistern for holding flushing water, a fill valve for filling the cistern and a flush unit for providing flushing water, wherein the flush unit comprises a flush valve with an overflow pipe and an actuator element for operating the flush valve, wherein the extractor unit comprises a fan for extracting air through an air duct, which extends at least partially through the cistern, and a filter element for filtering the air, wherein the filter element represents the end of the air duct, wherein the actuator element, fan and filter element are mounted on a common housing or in a common housing, wherein the actuator element comprises at least one motor and an actuator lever driven by the motor which acts with an output lever on the at least one actuator lever, wherein the actuator lever is pivotably mounted relative to the bearing element, which bearing element is connectable to the housing, and wherein the housing comprises a control cam for aligning the actuator lever during installation, wherein the control cam moves the actuator lever when connecting the bearing element to the housing, such that the actuator lever can be brought into engagement with the flush valve.

2. The flushing device according to claim 1, wherein the housing comprises an upper housing part and a lower housing part, which can be interlocked with one another.

3. The flushing device according to claim 1, wherein the housing provides part of the air duct, wherein the overflow pipe discharges into the housing.

4. The flushing device according to claim 2, wherein the housing has a leak-proof design in relation to air and/or in relation to water.

5. The flushing device according to claim 3, wherein the housing has a leak-proof design in relation to air and/or in relation to water.

6. The flushing device according to claim 1, wherein the housing is for the most part above the water line of the cistern and therefore only has minimal contact with the flushing water when the cistern is completely full.

7. The flushing device according to claim 1, wherein the housing is designed separately from the cistern and mounted on the cistern.

8. The flushing device according to claim 7, wherein the housing is connected to the cistern via a snap-action connection.

9. The flushing device according to claim 7, wherein the housing is connected to the cistern using the lower housing part.

10. The flushing device according to claim 8, wherein the housing is connected to the cistern using the lower housing part.

11. The flushing device according to claim 1, wherein the fan and the filter element is mounted on the upper housing part and/or the actuator element is mounted at least partially on the lower housing part.

12. The flushing device according to claim 1, wherein the motor is a servo motor.

13. The flushing device according to claim 1, wherein the actuator lever of the actuator element is mounted on the lower housing part and wherein the motor is mounted on the upper housing part.

14. The flushing device according to claim 1, wherein said bearing element is connectable to the lower housing part.

15. The flushing device according to claim 14, wherein the actuator lever can be brought into engagement with a control rod of the flush valve.

16. The flushing device according to claim 14, wherein the housing comprises an opening through which at least one control rod of the flush valve can be guided, wherein the at least one control rod is connected to the at least one actuator lever.

17. The flushing device according to claim 16, wherein the housing has an edge sticking out from the housing around the aforementioned opening, which edge extends away from the housing into the inside of the cistern up to beneath the water line when the cistern is completely full.

18. The flushing device according to claim 1, wherein the filter element is a filter cartridge which is mounted in a replaceable manner in a holder integrally formed on the housing.

19. The flushing device according to claim 1, wherein the housing has a further opening in the region of the filter element via which air can be fed to the filter element.

20. The flushing device according to claim 1, wherein the fill valve is connected to the housing or is mounted on the housing.

21. The flushing device according to claim 4, wherein a seal is arranged between the upper housing part and the lower housing part.

22. The flushing device according to claim 18, wherein the holder is mounted on the outside of the housing.

23. The flushing device according to claim 18, wherein the holder is mounted on the upper housing part.

* * * * *